US006871739B2

(12) United States Patent
Lopez

(10) Patent No.: US 6,871,739 B2
(45) Date of Patent: Mar. 29, 2005

(54) FOLDABLE PADDED CASE FOR A PERSONAL COMPUTER

(76) Inventor: Carlos Lopez, 313 W. 54th St., #1RW, New York, NY (US) 10019

( * ) Notice: Subject to any disclaimer, the term of this patent is extended or adjusted under 35 U.S.C. 154(b) by 78 days.

(21) Appl. No.: 10/405,318

(22) Filed: Apr. 1, 2003

(65) Prior Publication Data

US 2004/0195146 A1 Oct. 7, 2004

(51) Int. Cl.[7] ..... A45C 7/00; A45C 5/12; B65D 71/00

(52) U.S. Cl. ..... 206/320; 206/523; 206/524; 206/576; 190/11; 190/18 R; 190/107; 190/901

(58) Field of Search ..... 190/2, 107, 901, 190/11, 18 R; 206/320, 523, 524, 576

(56) References Cited

U.S. PATENT DOCUMENTS 1,700,315 A * 1/1929 Hopkins ..... 383/42
1,754,663 A * 4/1930 Adams ..... 190/115
3,173,465 A * 3/1965 Pastini ..... 150/108
4,489,815 A * 12/1984 Martinez et al. ..... 190/1
4,515,493 A * 5/1985 Radovich ..... 402/4
5,445,266 A * 8/1995 Prete et al. ..... 206/320
5,607,054 A 3/1997 Hollingsworth ..... 206/320
5,904,230 A * 5/1999 Peterson ..... 190/107
5,971,148 A 10/1999 Jackson ..... 206/320
6,000,545 A * 12/1999 Smith ..... 206/523
6,073,770 A * 6/2000 Park ..... 206/522
6,149,001 A 11/2000 Akins ..... 206/320
6,269,948 B1 8/2001 Jackson ..... 206/320
6,334,533 B1 * 1/2002 Hollingsworth et al. .... 206/320
6,354,477 B1 3/2002 Trummer ..... 224/575
6,604,618 B1 * 8/2003 Godshaw et al. ..... 190/107
2003/0057131 A1 * 3/2003 Diaferia
2004/0011616 A1 * 1/2004 Rasmussen

* cited by examiner

*Primary Examiner*—Sue A. Weaver
(74) *Attorney, Agent, or Firm*—Howard Lebowitz

(57) ABSTRACT

The invention pertains to a foldable carrying ease for a notebook computer which has two states an open state wherein the notebook computer can be used on the open case and a closed state wherein the notebook computer can be transported with the computer being protected with padding on all 6 faces of the computer. The computer case is sized closely to the dimensions of the computer to provide a carrying case that is approximates the dimensions of the case plus the thickness of padding.

12 Claims, 3 Drawing Sheets

FOLDABLE PADDED CASE FOR A PERSONAL COMPUTER

BACKGROUND OF THE INVENTION

1. Field of the Invention

This invention pertains to carrying cases for laptop computers, particularly those cases that are easily convertible between a first configuration where it is a safe and convenient carrier while transporting the computer and a second configuration where it is a platform for using the computer at the destination.

2. Description of the Prior Art

There are a plethora of different types of carrying cases for laptop or notebook computers. The great variety among carrying cases is a good indication that none of the different designs are ideal. This condition is at least in part due to the versatility of the laptop computer to perform a wide range of functions for a wide range of users.

While not intended to be limiting, the type of computer being discussed is the laptop or notebook computer which generally has a base section containing a keyboard, disk drives, power supply and other components and a screen which is generally attached to the base by hinges so that the screen can be pivoted upward during use and downward against the base for storage and transportation. The screen is generally held closed by a latch. These computers vary substantially in size and weight, the trend being towards more and more powerful machines in a smaller and lighter package.

There are two extremes in the world of laptop carrying cases. At one end is the carrying case that might be ideal for the familiar 'road warrior' individual whose computer is the center of a very complete mobile office. This type of carrying case might resemble a suitcase or a large sample case having a padded compartment within to safely carry the laptop computer.

Another extreme is the carrying case that might be desired by a user who thinks of a laptop computer by the synonymous name, the notebook computer. This user might have a paradigm for using the computer which is very similar to the familiar notebook that might be carried by a student, professor, author or scientist to record notes, thoughts and impressions, and to work on different writings or calculations under different circumstances as they present themselves during the day, varying from the kitchen table, to a picnic table, to a desktop, a lecture hall, or on the ground under a tree in the park. This type of user wants three things from a computer case, to wit, a lean and efficient form factor—light weight and not much larger than the computer itself—supporting the notebook paradigm: protection from the elements and from physical impacts and insults during transportation; and convenience of use upon arrival at a variety of different circumstances. The instant invention is directed to this latter type of user.

A classic carrying case is a permanent box having a bottom, a top, and four sides. Such a case generally looks very much like a brief case or attachê case, and possibly a handle or shoulder strap for carrying. The case may have padding on the top, bottom, or sides or internally in a compartment intended for the computer. The case is generally neither efficiently sized nor lightweight. The case needs to be stowed when the computer is in use. The case may protect the computer from the elements and from physical contacts with the outside world, depending on its structure.

A few carrying cases of the type that can be used for both transportation and use of laptop computers are interesting in defining needs and desirable attributes of carrying cases.

U.S. Pat. No. 6,354,477, which is hereby incorporated herein by reference, to Trummer, discloses a carrying bag that looks very much like a classic brief case in a carrying mode and can be configured as a briefcase, shoulder bag or backpack depending on how a number of configurable straps and handles are used. The case contains an internal compartment for the computer and a plurality of other pockets and accommodations. The case is made of a flexible panel and at least three rigid panels, pivotably connected so that the case can be unfolded for use as a support for the computer when used on a flat surface or a support for using the computer suspended by a neck strap of an erect user. Trummer's carrying bag can provide good protection from the elements and physical impacts and abuse depending on the construction of the panels. The bag has many novel uses to support the computer in use. However it is by no means a lean and efficient form factor supporting the notebook paradigm.

U.S. Pat. No. 5,607,054 to Hollingsworth, which is hereby incorporated herein by reference, is a folio carrying case, which comprises four stiffened panels one flexibly connected to another so that the panels can be folded around the top, bottom, front and back of the computer. Protective padding is provided top and bottom and just a covering on the sides. The ends of the computer are open to the elements. The folio can be folded into a convenient ergonomic base for the computer where the front panel (flap) serves as a wrist support. Hollingworth's folio has a lean efficient form factor that certainly supports the notebook paradigm. It serves a useful function when the computer is in use. However, the folio supplies little protection against the elements since it is open on the sides and protects only the top and bottom surfaces with padding against impact.

U.S. Pat. No. 6,149,001, which is hereby incorporated herein by reference, to Akins, is a cover for a Laptop or Notebook Computer. Akins' cover is a thin flexible material adapted to fit over the computer like a glove. Akins' cover has cutouts for the keyboard, screen, controls, ports, and etc. of the computer so that it does not interfere with use of the computer. The computer may be carried or used with the cover installed. Akins cover certainly has a lean and efficient form factor consistent with the notebook paradigm of using a notebook computer. The cover is in place and provides some protection when the computer is in use, however it provides hardly any protection against either impact or the elements.

U.S. Pat. Nos. 5,971,148 and 6,269,948, both of which are hereby incorporated herein by reference, to Jackson disclose luggage for nomadic computing, which is an article for use of a laptop computer on a user's lap and for protecting the computer during non-use. The article comprises a base panel and four panels extending from the base panel, two side panels, a front panel, and a rear panel. The side panels each contain storage compartments. When in use, the side panels drape over the user's thighs while the front panel rolls up to form a wrist rest and the rear panel is rolled up or draped in front of the user. For transportation purposes, the front and rear panels are folded over the computer and the side panels are folded over them. The shape factor of is relatively lean and efficient except the storage panels add bulk. The computer is protected to some extent by stiffening added to the bottom panel and may be protected by the storage pouches on the top, however the front, back, and two sides are not protected against impact by padding due to desired flexibility characteristics of the article and its use to drape over a users lap while being used.

While there are many laptop computer carrying cases available there is a need for an improved case which satisfies the deficiencies of the prior art, and is particularly suitable for users of the type who carry a computer for use as a notebook in order to do work under a variety of conditions.

There is a need for a laptop computer carrying case which supports use as a notebook, simultaneously providing a lean, lightweight and efficient form not much larger than the computer itself, while simultaneously providing complete protection of the entire computer against impact and the elements during transportation of the computer and providing a useful base supporting convenient use of the computer when it is in use.

SUMMARY OF THE INVENTION

It is an object of the invention to provide a carrying case for a laptop computer that is more useful than the prior art to a user who uses a laptop computer according to the notebook paradigm where the computer is carried about under a variety of circumstances.

It is a further object of the invention to provide a laptop computer carrying case that is very compact and lightweight to carry about, provides the laptop computer with padded impact protection and protection against the elements on all surfaces of the computer during storage, and provides a convenient platform for using the laptop computer in the field.

The instant invention pertains to a carrying case suitable for use in carrying about a notebook or laptop computer. A typical laptop computer is one comprising a screen part hingedly connected to a console part containing a keyboard, and the computational hardware. The invention is not limited to this variety of notebook and could also be advantageously employed with other varieties of compact portable computers such as a Tablet PC where inputs may be made directly to the screen with a stylus device, or hybrid devices in which inputs could be made either with a keyboard or a stylus device. Generally the invention could be used with any portable computing device which is suitable to be carried about and used under a variety of circumstances by a user. While the invention may be described for use with one or another variety of notebook computer it should be understood that any style of portable notebook computer may be substituted within the scope of the invention.

The carrying case is directed at two distinctive properties of notebook computers. The first property is that the computers themselves are fragile machines. In particular the screen portion is subject to shattering by impact and the various connectors and ports including CD reading/writing devices are subject to damage by impact and by exposure to the elements such as water. The second property is that the notebook computers are versatile and may be used in a number of different circumstances that arise from a person carrying the device around like a real notebook. For example, a user might be working at a desk with the notebook computer connected to peripherals, the user might use the computer in class taking notes, alternatively a user might use the notebook working on a project at the park while sitting on the ground, or a user might take the computer on an airplane. In all cases, one object of the invention is to protect the computer against impact and the external elements, such as water, while in transport, while at the same time not inhibiting carrying the computer around like a notebook. The second object is to provide a base for using the computer when in use during the variety of activities that might be encountered.

One preferred embodiment of the invention is a carrying case that has two states, a closed state where it provides a protective covering for a notebook computer contained within when transporting or storing the computer, and an open state where the case folds out into a substantially flat horizontal position with at least one mouse pad and preferably two mouse pad surfaces on either or both sides of the computer, a padded surface under the computer, and preferably, unpadded flexible front and rear panels which can be rolled up to form a flexible ergonomic wrist pad and a support to provide the computer at a desired angle.

In the closed state the case folds into a rectangular shaped box to hold the computer between padded surfaces top, bottom, and all four edges, the box sized to closely fit the notebook computer within a compartment approximating the computer plus the cumulative thickness of the padding, thus providing a compact profile for ease of protection as well as complete protection.

The folded surfaces are preferably held together with quick release fasteners, preferably of the hook and loop type, such as Velco™, so that the case can be converted quickly and easily from the closed state to the open state and vice versa. The padding is preferably dense foam padding such as is often used in kneepads, so that each added surface might be in the range of about ⅛ inch to about ½ inch.

A preferred embodiment is a carrying device for use with a portable computer, the portable computer having a top surface, a bottom surface, and four edge surfaces, the carrying device comprising:

a) a base panel having an upper surface for receiving the portable computer, an opposing lower surface, two opposing side edges and two opposing end edges comprising a front end and a back end;

b) base panel padding between the upper surface of the base panel and the lower surface of the base panel;

c) two side pads, one of said two side pads foldably extending from each of the two opposing side edges of the base panel;

d) two end pads, comprising a front end pad foldably extending from the front end of the base panel and a back end pad foldably extending from the back end of the base panel;

e) two side panels, one of said two side panels foldably extending from each of the two side pads, each of the two side panels having an upper surface corresponding to the upper surface of the base panel and a lower surface corresponding to the lower surface of the base panel, wherein the upper surface of each of said two side pads is a smooth surface suitable for use as a mousepad;

f) mousepad padding between the upper surface and the lower surface of each of the side panels;

g) a flexible front panel, extending from the front end of the base panel;

h) a flexible back panel extending from the back end of the base panel; and i) first fastener means for forming the two side pads, the two end pads and the base panel into an open box for receiving the portable computer therein when the fastener means are fastened, whereby the portable computer may be transported in a closed state of the carrying device, with both top and bottom surfaces and all four edge surfaces of the computer protected by padding when the two side panels are folded over the open box, and whereby when the fastener means are released and the two side panels are folded back the carrying device assumes a horizontal position for use of the computer thereon.

In a preferred embodiment of the invention the carrying case is sized such that the computer fits snugly within the carrying device so that the overall dimensions in the closed state approximate the dimensions of the computer plus the thickness of the padding.

BRIEF DESCRIPTION OF THE DRAWINGS

These and other features, aspects and advantages of the present invention will become better understood with regard to the following description, appended claims and accompanying drawings, where:

DESCRIPTION

The invention is a carrying case intended for carrying and using a notebook computer or laptop computer. The type of computer is broadly the type comprising a screen part hingedly connected to a console part containing a keyboard, and the computational hardware that is colloquially called either a notebook computer or a laptop computer. An alternative type of notebook computer is the type that does not hinge open and closed but is a rectangular box with a screen part and keyboard part next to each other on a face of the rectangular box. Still another version of notebook computer that can be advantageously used in conjunction with the invention is the style known as a "Tablet PC" on which inputs are made directly onto a screen with a stylus much as writing on a tablet. Still another version of notebook computer for which the invention is intended is a hybrid computer having one state wherein inputs are made directly onto the screen with a stylus and a second state wherein inputs are made to a keyboard coupled or docked with the screen device. The defining characteristics of computing devices that are intended to be used with the invention is that they be the type of computing device that is capable of being carried about by a user and used in a variety of circumstances, and is fragile and should be protected against impact and moisture. A notebook computer generally has the overall shape of a box having approximately a rectangular top, a rectangular bottom shape, and comparatively thin rectangular sides and ends.

The characteristics of a carrying case according to the instant invention are that the device should provide a very compact profile for carrying the computer about like the user would carry a real notebook or tablet, that the device provide impact protective padding on all six external faces of a computer when carrying the computer, and provide protection against exposure to water, that the device can be used as a base for using the computer under a variety of circumstances, and that the device can be quickly and spontaneously converted from a storage and transportation state to a use state.

Figures 1A, 1B:
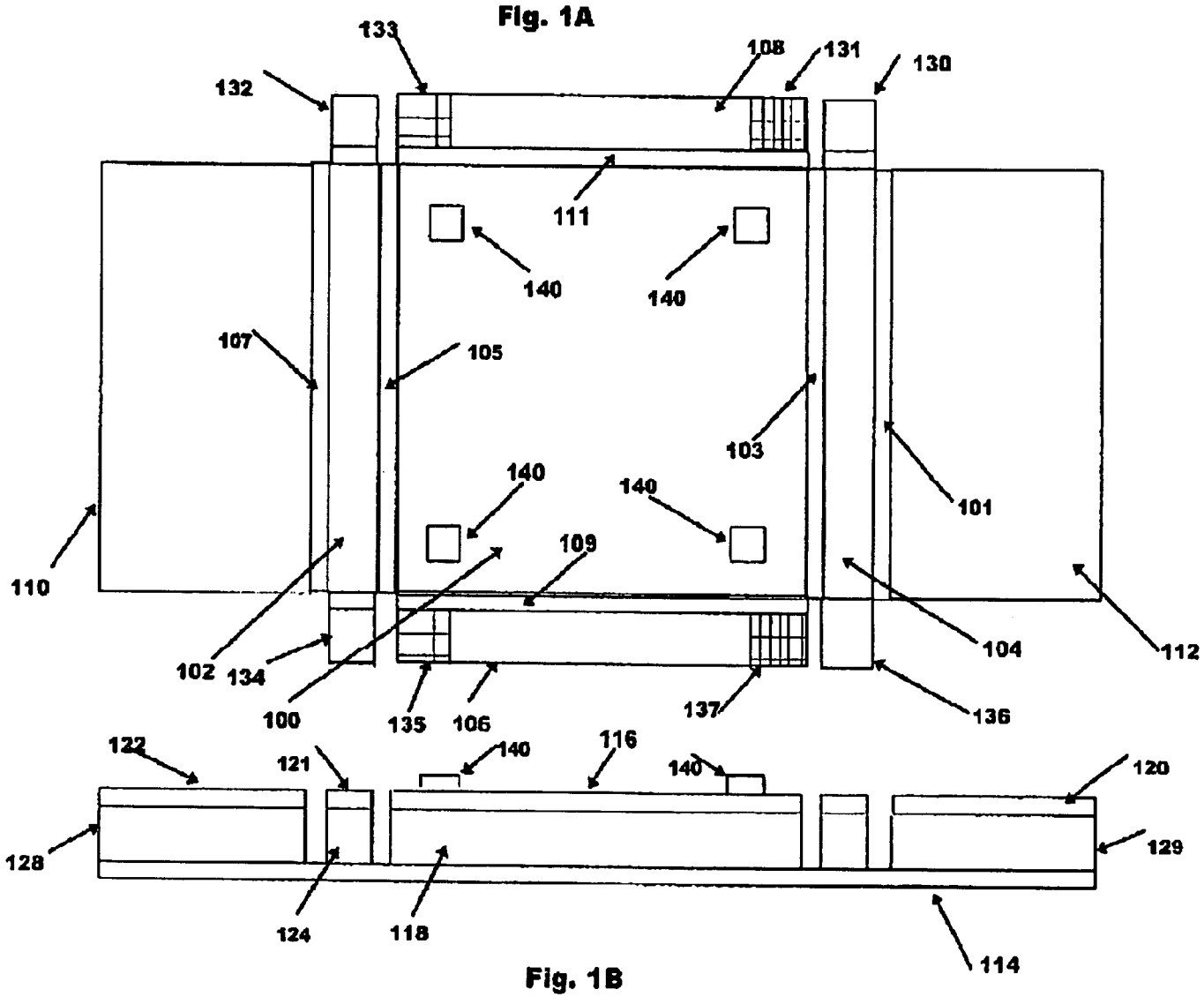
FIG. 1A is a plan view of a base panel with two side pads, two end pads, and two side panels.
FIG. 1B is a front view of the plan view shown in FIG. 1A.
Figure 2:
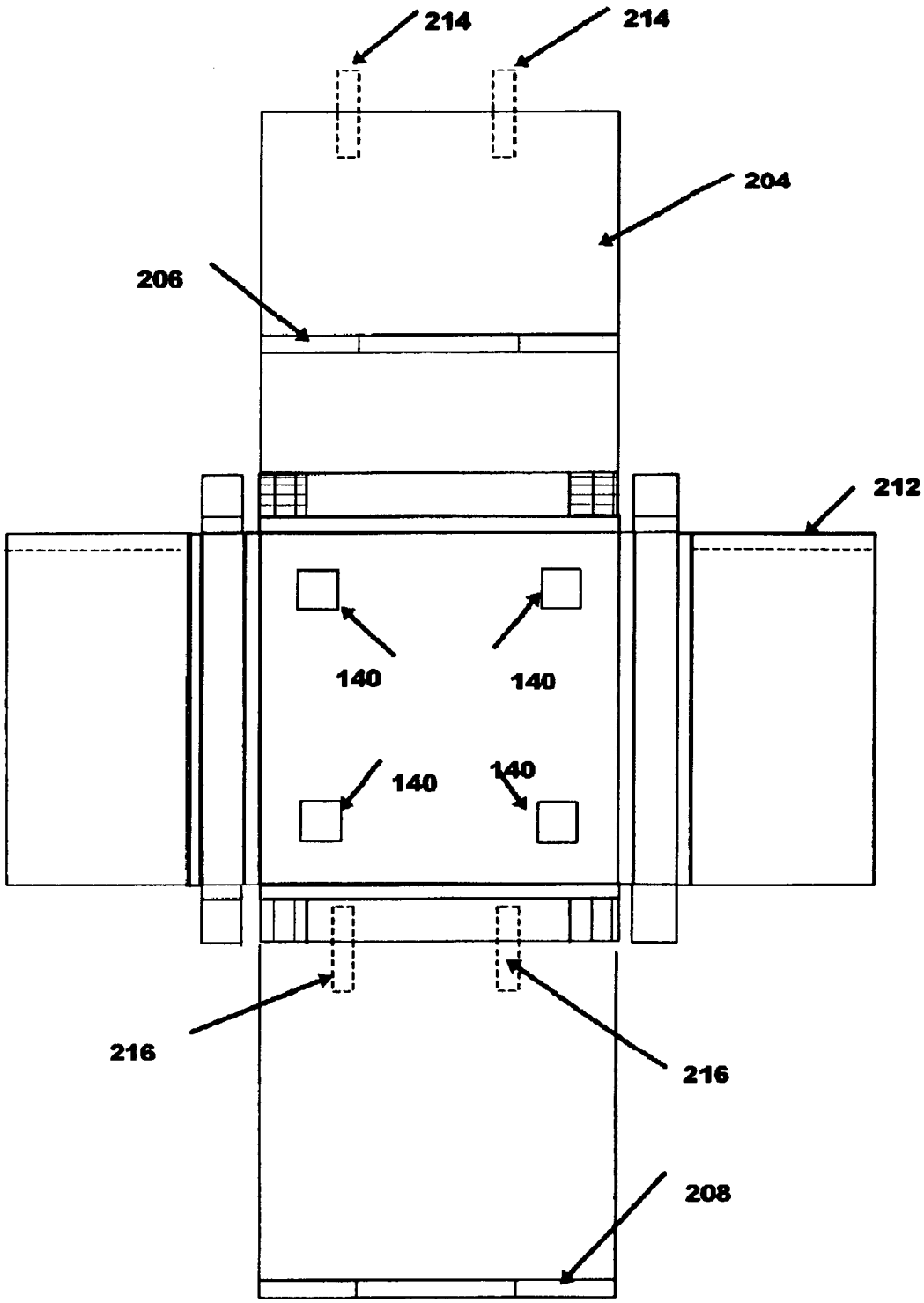
FIG. 2 is a top view of a carrying device as it would appear when open.
Figure 3:
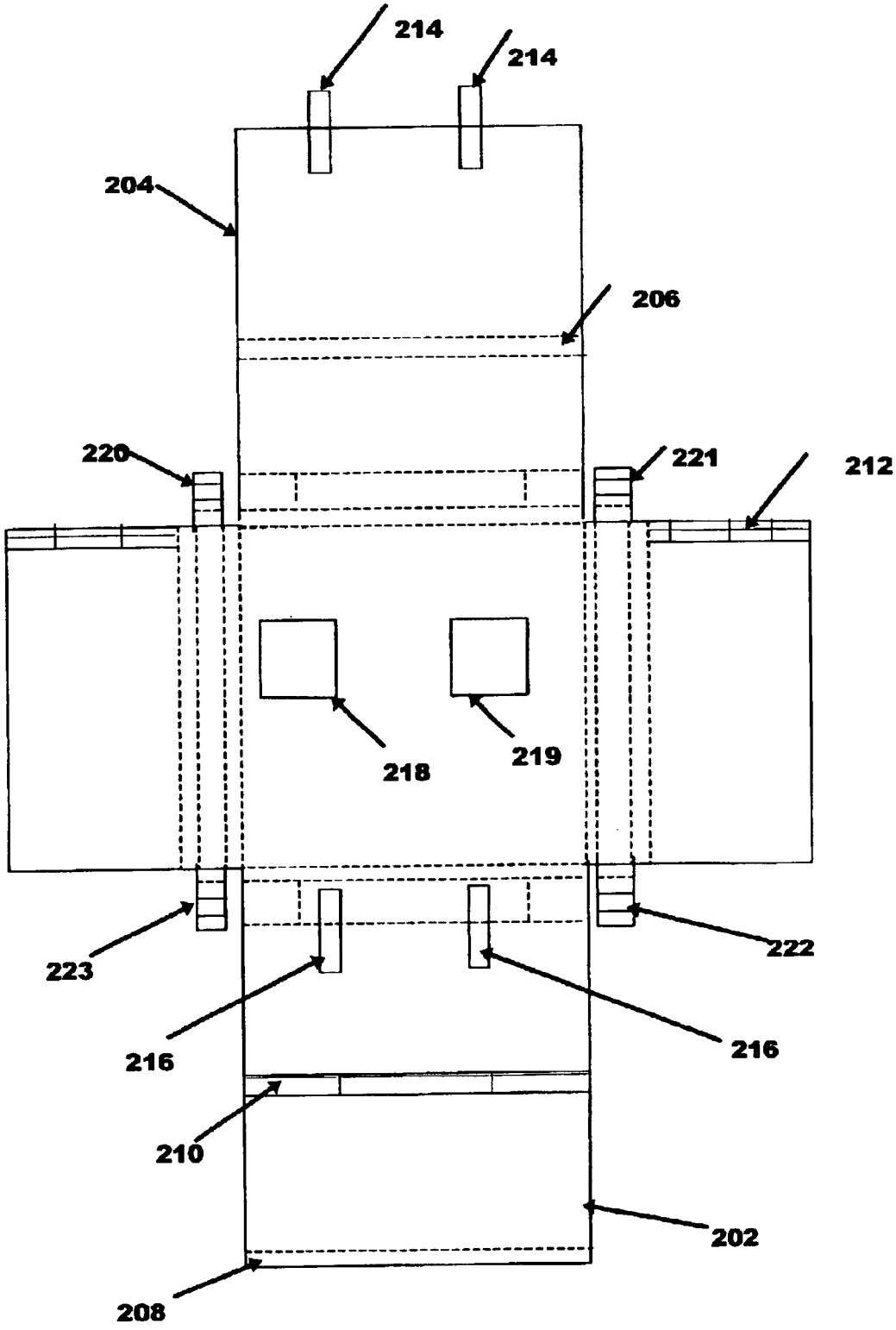
FIG. 3 is a bottom view showing the back face of the carrying device shown in FIG. 2.

A preferred embodiment of the invention is shown in the FIGS. 1, 2, and 3. A carrying case comprises a base panel, the base panel comprising an upper surface, a lower surface, and padding between the upper surface and lower surface. The upper surface refers to the surface of the base panel which will receive the computing device and the lower surface refers to the surface which will be the outside of the carrying device. The upper surface and lower surface of the base panel are preferably thin flexible fabric material such as nylon. The lower surface is preferably a harder fabric such as "pack cloth", preferably made waterproof by urethane coating. The upper surface is preferably a lighter weight fabric such as Cordura nylon. Of course, there are a variety of acceptable fabrics. It is desirable that the lower surface, which will face the outside, be a durable fabric that can be readily waterproofed. The upper surface that will face inside is preferably a lightweight durable fabric. The padding is preferably thin, dense foam which provides high impact resistance. A preferable type of foam is the type often used for athletic knee-pads such as neoprene or a closed-cell polyurethane foam. The thickness of foam is preferably about ⅛ to ½ inch thick more preferably ⅛ to about ¼ inch thick. It should be noted that the upper surface of the base panel need not be a separate fabric surface, but may refer to the upper surface of the padding. The fabric surfaces may be joined to the foam padding by conventional methods known in the art, such as thermal bonding or adhesive. The base panel preferably has a size and shape closely approximating the size and shape of the rectangular base of the computer that is intended for use with the case.

A carrying case according to the preferred embodiment further comprises four pads surrounding the base panel, two side pads and two end pads. The side pads and end pads extend foldably from corresponding sides and ends of the base panel. The side pads have a width corresponding approximately to the thickness of the computer and a preferably separated by a small fabric strip that is a continuation of the bottom surface of the base panel and has approximately the thickness of the padding in the base panel, so that each side or end pad can be snuggly folded against a side or end of the computer when the computer is resting on the base panel.

A carrying case according to the preferred embodiment further comprises first fastener means for forming the two side pads, two end pads, and the bottom panel into an open box surrounding the computer with padding on the bottom and all four sides. A convenient fastener means are hook and loop type fastener mating surfaces such, as preferably Velco™ surfaces, attached to the side pads and end pads.

A carrying case according to the invention further comprises at least one side panel foldably extending from one of the side pads, and that is suitable for use as a mouse pad when folded out and which serves as a pad to protect the top of the computer when folded in the carrying position. Preferably, the at least one side panel comprises two side panels, one each side each of which has a width dimension approximately half of the width of the base panel so that when folded over the top of a computer resting on the base panel will be covered. An alternative is to have one larger side/panel mouse pad extending from one of the side pads. The at least one side panel comprises a bottom surface, that is preferably a continuation of the same fabric which forms the bottom surface of the base panel and the side pads, a top surface, and padding between the bottom surface and the top surface of the side panels. The top surface of the at least one side panel is intended to be used as a mouse pad and will preferably be made from a durable, low slip fabric such as cloth mouse pads are made from such as preferably a tight weave polyester fabric.

Referring to the figures, FIG. 1A shows a plan view of a carrying case as thus far described and FIG. 1B shows a front view thereof. The carrying case comprises a base panel 100 comprising a top surface 116, a bottom surface 114, and padding 118. The carrying case further comprises side pads 102 and 104 and end pads 106 and 108. The side pads and end pads share the common bottom surface 114. Side pad 102, which is typical of the side and end pads, is shown comprising a top surface 121, padding 124, and top surface 121. There are gaps in the padding 103, 105, 109, and 111 between the bottom panel and the side and end panels having a width corresponding to the thickness of the padding. Note that the relation of the size of the components between the plan and front views, FIGS. 1A and 1B, are not to the same scale so that the items will all be visible. The fabric top and bottom surfaces are thicker than they should be compared to the thickness of the padding and the thickness of the padding in FIG. 1B is exaggerated compared to the gaps shown on FIG. 1A.

Continuing on FIGS. 1A and 1B, side panels 110 and 112 are shown comprising a bottom surface, that is the common bottom surface 114, padding 128 and 129, and mouse top surfaces 120 and 122. The side panels 110 and 112 are separated from the side pads 102 and 104 by gaps 107 and 101. The width of gap 107 and 101 approximately equaling the thickness of side pads 102 and 104, so the side panels can be snugly folded over the top of a compute resting on base panel 100.

Tabs 130, 132, 134, and 136 are foldable tabs, preferably made from the same type of hard fabric material that the bottom 114 of the padded surfaces is made from. These tabs have a hook and loop fastening surfaces, preferably a Velco™ surface, on the bottom side which are visible in FIG. 3 as 220, 221, 222, and 223. These fastening surfaces are mating surfaces to the fastening surfaces 131, 133, 135, and 137 which are found on the top surface of end pads 106 and 108, such that side pads 102 and 104 and end pads 106 and 108 can be folded up and fastened in place with the fastening surfaces 130, 131, 132, 133, 134, 135, 136 and 137 to form a box to hold a computer. When side panels 110 and 112 are folded over top of the box, a computer placed therein is fully protected on all six faces. Those skilled in the art will appreciate that the preferred fasteners described above in this paragraph are only one potential fastener means for forming the side pads, end pads, and bottom panel into an open box which protects a computer therein on the bottom, and four edges. Other equivalents include mechanical latches, threaded eyelets, zippers, and the like.

FIGS. 1A and 1B illustrate another advantageous feature which may be included in a carrying case comprising a plurality of pedestals 140 which hold a computer a distance away from the surface of the base panel. The pedestals are useful to prevent overheating of a computer which is in use in a carrying case which is in the open position due to the insulating properties of the foam materials used for padding. A pedestal is preferably made from the same material used for padding and may be from about ⅛ inch to ¼ inch thick, preferably ⅛ inch.

A computer case according to the invention preferably further comprises a flexible front panel and a flexible rear panel, preferably made of the same hard material as the bottom surface of the base panel and other padded parts. Alternatively, the flexible front panel and flexible rear panel can comprise a thinner layer of padding than the other padded parts. In this alternative a preferred material is ⅛ inch thick neoprene padding. FIG. 2 is a top view showing the open face of the case ready to receive a computer, and FIG. 3 is a bottom view showing the outside of the case. A flexible front panel 202 and a flexible back panel 204 are shown.

When the computer case is folded up to carry a computer within the case, the side pads are folded up to make a box as previously described, the side panels are folded over top of the computer and the flexible front and back panels are folded over top of the side panels. The case is held tightly together and the side panels held in place by hook and loop fastening surfaces running across the front and back panels and two side panels. These are shown as 208 which mates with surface 212 when the case is folded up and surface 206 which mates with surface 210. Also the flexible front panel and flexible back panel are secured with fasteners 214 and 216. Those skilled in the art will appreciate that equivalents include zippers, mechanical fasteners and the like.

FIG. 3 shows that a computer case may optionally contain one or more small pockets, 218 and 219, such as for holding a mouse and compact disc or floppy disc. The case may also have clips for attaching a shoulder strap or handle.

One desirable feature of a carrying case is to construct it of a number of discreet padded structures, namely a bottom panel, two side pads, two end pads, and at least one side panel. The discreet nature of these structures is reflected on the drawings by the unpadded strip between the structures, including the zones labeled 103, 105, 107, 109 and 111 on FIG. 1A. The width of these gaps approximate the height of padding in the adjacent structure so that the case will fold up compactly around a computer. One option is to have some degree of padding over the entire carrying case and thicker padding for the discreet padded structures.

The case can be constructed by starting with a piece of fabric suitable for the bottom surface such as "pack cloth" or another suitable fabric; cutting the fabric into the desired shape of the case; attaching the padding structures, including the bottom panel, the side and end pads and the at least one side panel, to the fabric; attaching the top fabric; and attaching the fastener surfaces. Alternatively, if all of the padding is to be the same type, a single piece of padding can be attached to the bottom surface and the gaps cut out.

The case is used as a carrying case by placing the bottom surface of a computer on the top surface of the bottom panel, folding up the side and end pads around the edges of the computer, fastening the fastener means to form an open box of padding around the edges of the computer, folding the at least one side panel over the top of the computer, folding the flexible front panel and back panel over the at least one side panel and fastening the second fastener means for securing the case.

The computer case is used by reversing the procedure. The case folds flat on a flat surface such as on the ground or on a table. The at least one side panel is used as a mouse pad, the front panel is folded into a cylinder and used as a wrist rest. The back panel can be used to support the computer.

Although the present invention has been described in considerable detail with reference to certain preferred versions thereof, other versions are possible. Therefore the spirit and scope of the appended claims should not be limited to the preferred versions herein.

What is claimed is:

1. A carrying case for use with a portable computer, the portable computer having a top surface, a bottom surface, and four edge surfaces, the carrying device comprising:

a) a base panel having an upper surface for receiving the portable computer, an opposing lower surface, two opposing side edges and two opposing end edges comprising a front end and a back end;

b) base panel padding between the upper surface of the base panel and the lower surface of the base panel;

c) two side pads, one of said two side pads foldably extending from each of the two opposing side edges of the base panel;

d) two end pads, comprising a front end pad foldably extending from the front end of the base panel and a back end pad foldably extending from the back end of the base panel;

e) two side panels each side panel foldably extending from one of the two side pads, the at least one side panel having an upper surface corresponding to the upper surface of the base panel and a lower surface corresponding to the lower surface of the base panel, wherein the upper surface of said at least one side panels is a smooth surface suitable for use as a mousepad;

f) mousepad padding between the upper surface and the lower surface of each of the side panels;

g) a flexible front panel, extending from the front end of the base panel;

h) a flexible back panel extending from the back end of the base panel;

i) first fastener means for forming the two side pads, the two end pads and the base panel into an open box for receiving the portable computer therein when the fastener means are fastened, whereby the portable computer may be transported with both top and bottom surfaces and all four edge surfaces protected by padding when the two side panels are folded over the box, and whereby when the fastener means are released and the two side panels are folded back the carrying device assumes a horizontal position for use of the computer thereon; and j) a plurality of pedestals mounted on the base panel.

2. The carrying case of claim 1 wherein the front panel and back panel are made of a thin material without padding added thereto, whereby the front panel and back panel may each be readily rolled up into a cylinder, whereby the front panel is suitable for use as a wrist pad and the back panel is useable to support the computer.

3. The carrying case of claim 1 wherein the two side pads, the two end pads, the base panel and the two side panels are each discreet structures.

4. The carrying case of claim 3 wherein each of the two side pads and each of the two end pads are disposed to define an unpadded space between itself and the base panel.

5. The carrying case of claim 4 wherein an unpadded space between a side pad and the base panel has a width approximately equal to the thickness of padding material in the base panel.

6. The carrying case of claim 3 wherein each of the two side panels is discreet from the side pad from the side pad from which it extends.

7. The carrying case of claim 6 wherein each of the two side panels is disposed to define an unpadded space between itself and the side pad from which it extends, wherein the width of each unpadded space between a side pad and a side panel approximates the thickness of the padding in the side pad.

8. The carrying case of claim 7 where the plurality of pedestals comprise four pedestals.

9. The carrying case of claim 8 wherein the base panel, the two side pads, the two end pads, and the two side panels comprise ¼ inch neoprene padding and each pedestal comprises ⅛ inch neoprene padding.

10. The carrying case of claim 9 wherein the front panel and back panel comprise ⅛ inch thick neoprene padding.

11. The carrying case of claim 10 further comprising second fastener means for holding the side panels together.

12. The carrying case of claim 11 wherein the bottom surface of the base panel, two side pads, two end pads, and two side panels is made from a single piece of fabric.

* * * * *